US011242861B2

(12) United States Patent
Peppard et al.

(10) Patent No.: US 11,242,861 B2
(45) Date of Patent: Feb. 8, 2022

(54) SPLIT FAN COLLAR ORIFICE

(71) Applicant: TRANE INTERNATIONAL INC., Davidson, NC (US)

(72) Inventors: Gregory M. Peppard, Clarksville, TN (US); Michael Griffith, White Bluff, TN (US); Aaron Stevens, Spring Hill, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 370 days.

(21) Appl. No.: 16/230,648

(22) Filed: Dec. 21, 2018

(65) Prior Publication Data

US 2020/0200183 A1 Jun. 25, 2020

(51) Int. Cl.

| | |
|---|---|
| ***F01D 25/24*** | (2006.01) |
| ***F04D 29/28*** | (2006.01) |
| ***F24F 13/20*** | (2006.01) |
| ***F04D 29/42*** | (2006.01) |
| *F24F 1/56* | (2011.01) |

(52) U.S. Cl.

CPC ..... *F04D 29/281* (2013.01); *F01D 25/24* (2013.01); *F04D 29/4226* (2013.01); *F24F 13/20* (2013.01); *F24F 1/56* (2013.01)

(58) Field of Classification Search

CPC .... F01D 25/24; F04D 29/4226; F04D 29/424; F24F 13/20; F24F 1/56

See application file for complete search history.

(56) References Cited

U.S. PATENT DOCUMENTS

| | | | | |
|---|---|---|---|---|
| 7,244,110 | B2 | 7/2007 | Hong et al. | |
| 2014/0252770 | A1 | 9/2014 | Patel et al. | |
| 2015/0184872 | A1* | 7/2015 | Oh | F24F 1/60 165/122 |
| 2017/0016633 | A1* | 1/2017 | Jeon | F24F 1/005 |
| 2020/0141277 | A1* | 5/2020 | Cooper | F01D 25/24 |
| 2020/0378628 | A1* | 12/2020 | Tomioka | F24F 1/50 |

FOREIGN PATENT DOCUMENTS

KR 101564219 10/2015

* cited by examiner

*Primary Examiner* — David E Sosnowski
*Assistant Examiner* — Sabbir Hasan
(74) *Attorney, Agent, or Firm* — Hamre, Schumann, Mueller & Larson, P.C.

(57) ABSTRACT

A split-collar fan orifice apparatus and method are disclosed. The split-collar fan orifice includes a generally semi-annular member having a first end and a second end, the member having an inner surface and an outer surface. The member has a first mating surface on the first end and a second mating surface on the second end. The first mating surface and the second mating surface are different. The split-collar fan orifice further includes a plurality of ribs disposed along the outer surface of the member. The plurality of ribs is configured to provide rigidity to the member. The plurality of ribs includes a first rib and a second rib, and the first rib extends in a first direction and the second rib extends in a second direction.

18 Claims, 7 Drawing Sheets

SPLIT FAN COLLAR ORIFICE

FIELD

This disclosure relates generally to an axial fan collar. More specifically, the disclosure relates to a split fan collar orifice for use in a heating, ventilation, air conditioning, and refrigeration (HVACR) system.

BACKGROUND

A heating, ventilation, and air conditioning (HVACR) system typically includes a compressor, a condenser, an expansion device, and an evaporator, combined to form a refrigeration circuit. The HVACR system can include a condenser fan configured to draw air over the condenser. A condenser fan is often placed within a duct. The outlet of the duct generally includes a grille, which serves to prevent anything from reaching the moving parts of the condenser fan.

SUMMARY

This disclosure relates generally to an axial fan collar. More specifically, the disclosure relates to a split fan collar orifice in an HVACR system.

A split fan collar orifice in a fan assembly is disclosed. The split fan collar orifice includes a half-collar that includes a generally semi-annular member having a plurality of ribs along an outer surface of the member.

A fan orifice assembly is also disclosed. The assembly may include a semi-annular first member having a first mating end and a second mating end, and a semi-annular second member having a third mating end and a fourth mating end. The fan orifice assembly can also include a first secured-connection between the first mating end and the third mating end, and a second secured-connection between the second mating end and the fourth mating end. In a secured state, the first member and the second member form an orifice. A plurality of ribs may be disposed along an outer surface of the first member and the second member.

A method of manufacturing a fan orifice is also disclosed. The method includes forming a first member and forming a second member. The second member may be identical to the first member. The method may also include securing the first member to the second member to form the fan orifice.

BRIEF DESCRIPTION OF THE DRAWINGS

References are made to the accompanying drawings that form a part of this disclosure, and which illustrate embodiments in which the systems and methods described in this Specification may be practiced.

The concepts described in the present disclosure are illustrated by way of example and not by way of limitation in the accompanying drawings. For simplicity and clarity of illustration, elements illustrated in the drawings are not necessarily drawn to scale. For example, the dimensions of some elements may be exaggerated relative to other elements for clarity.

Like reference numbers represent like parts throughout.

DETAILED DESCRIPTION

Figure 1:
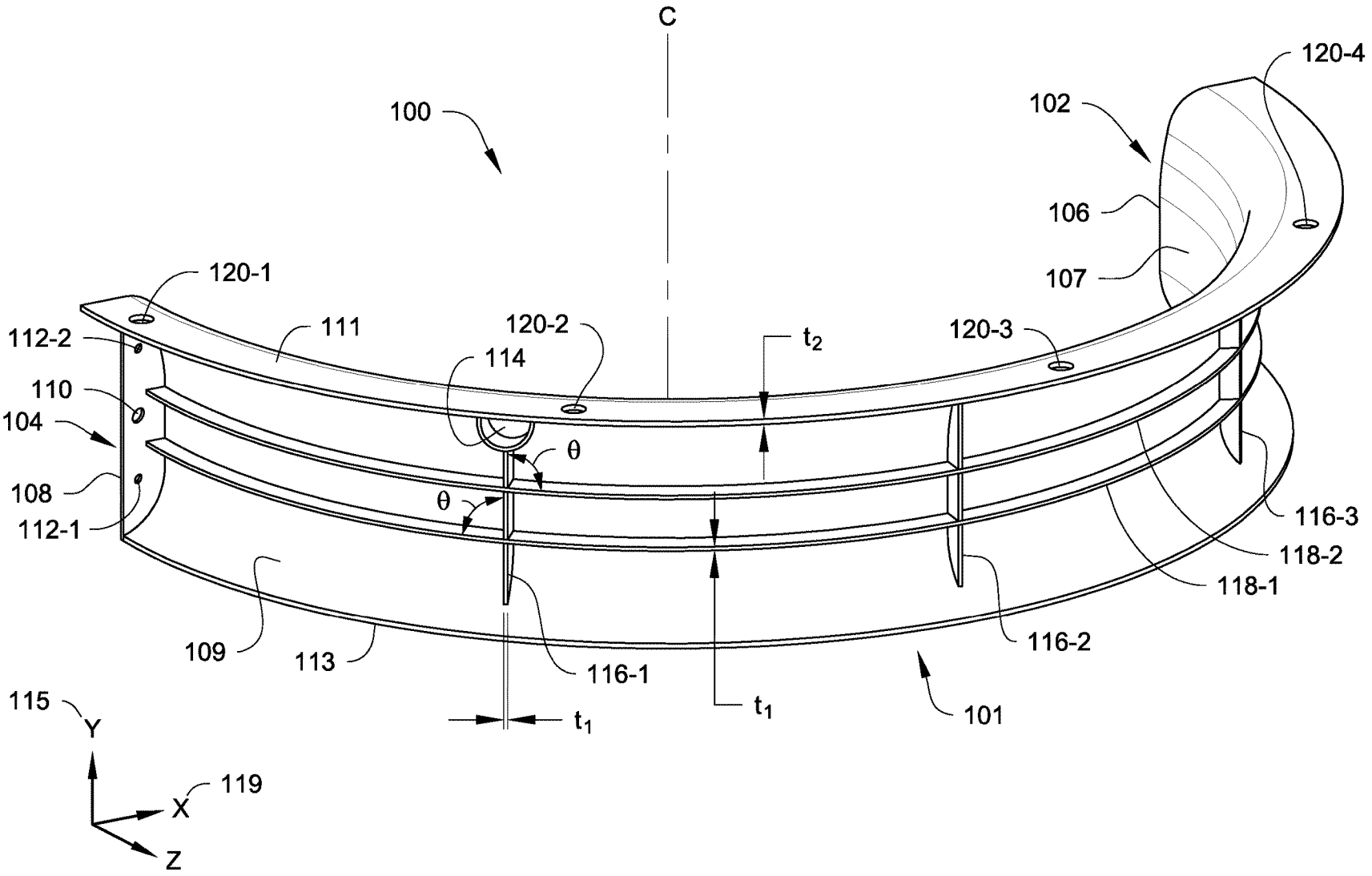
FIG. 1 illustrates a perspective view of a half-collar, according to some embodiments.

Traditional fan collar orifices are generally smooth walled cylinders that may be flexible. When a fan collar is stored or transported, for example, subsequent to manufacturing, for assembly and/or installation, or the like, the smooth walled cylinders may not nest easily. For example, in some instances, the smooth walled cylinders may be stacked in such a manner that one complete fan collar orifice is stacked on a top of another fan collar. The smooth walled cylinders can allow the parts to warp and deform under shipping loads, during storage, or the like. The number of smooth walled cylinders that may be stacked may be limited due to space limitations and/or potential damage to parts. The limitations associated with the stacking of the smooth-walled cylinders may necessitate additional resources, such as space, repairing of damages, etc., to obtain a proper number of fan collars for use (e.g., assembly, installation, etc.).

The fan collars having smooth walled cylinders may not withstand applied weight, thereby becoming deformed and unfit for use.

Embodiments of this disclosure are directed to a split fan collar orifice in a fan assembly. The split fan collar orifice described includes a half-collar that includes a generally semi-annular member having a plurality of ribs along an outer surface of the member. During transport, storage, or the like, a plurality of split fan collar orifices and/or the half-collar may be stacked (e.g., nested) one upon the other. The stacking of the half-collars may apply more weight to the components during transportation or storage than a weight and/or force that may actually be applied during operation. The plurality of ribs can improve the rigidity of the half-collar orifice when subjected to external forces not typical during operation and accordingly may strengthen the collars to withstand weight and/or forces applied during the transportation process or storage.

The increased rigidity can support an increased number of half-collars that may be stacked and/or a greater number of collars that may be included in a shipping or storage container. For example, more half-collars may be stacked without warpage as compared to traditional circular axial fan collars. Additionally, in some examples, the half-collars may occupy less space than the traditional circular axial fan collar.

In some embodiments, the half-collar apparatus can include a conduit-knockout feature. The conduit-knockout can allow a pass through (e.g., a hole) for wiring. Two half-collar apparatuses may be connected to form a split fan collar orifice.

The split fan collar orifice can be used as an axial fan collar in a refrigeration unit, in some examples. A refrigeration unit can, for example, include an air-cooled water chiller (e.g., compressor, condenser, expansion device, and evaporator), an air-cooled condenser unit (e.g., compressor, condenser, expansion device, and evaporator), or other similar unit in an HVACR system including multiple axial fans.

More particularly, embodiments disclosed are directed to the split fan collar orifice that comprises a half-collar apparatus. The half-collar apparatus includes a generally semi-annular member having a first end and a second end. The member includes a first mating surface on the first end and a second mating surface on the second end. The first mating surface and the second mating surface are different. For example, the second mating surface may include an alignment post, and the first mating surface may include an alignment post-hole. The alignment post and the alignment-post hole may be connected to form an intermediate connection.

The member has an inner surface and an outer surface. In some examples, the inner surface can be smooth. The member can include a plurality of ribs disposed along the outer surface. In some embodiments, the plurality of ribs includes a first rib and a second rib. The first rib extends in a first direction and the second rib extends in a second direction. The plurality of ribs is configured to provide rigidity to the member. For example, the plurality of ribs can provide structural support such that the split fan collar orifice maintains a rigid structure to withstand forces applied to the member.

In some embodiments, the second direction can be different from the first direction. For example, the first rib and the second rib can be substantially perpendicular relative to a circumference of the member. The first rib may extend in a vertical direction while the second rib extends in a horizontal direction.

In some embodiments, the first direction can be a longitudinal direction relative to a longitudinal axis of the member and the second direction is a circumferential direction about a circumference of the member. The member may have a greater circumferential length than longitudinal length along which the plurality of ribs is disposed. For example, the plurality of ribs can be angled along the outer surface of the member. The first rib and second rib may intersect to form an angle θ approximately 90 degrees. In other embodiments, the first rib and the second rib may intersect to form an angle θ greater than 90 degrees.

In some embodiments, a thickness of each of the plurality of ribs can be less than a thickness of the member. That is, the thickness (e.g., material width, density, mass, or the like) of the member may be greater than the thickness of the plurality of ribs. For example, a ratio of the thickness of the plurality of ribs to the thickness of the member can be 2:3 or less.

The split fan collar orifice can include a conduit knock-out on the member, in some embodiments. The conduit knock-out is configured to form a hole in the inner surface and outer surface of the member. The conduit knock-out can be located nearer to a respective end (e.g., the first end or the second end) of the member than a center of the member.

The member, in some embodiments, can be made of a first material and the conduit knock-out can be made of a second material. For example, the second material can be a thinner material than the first material. The thinner material may be capable of breaking from the member to form the hole. Additionally, or alternatively, in some embodiments, the first material and the second material can be the same material while having different thicknesses.

In some embodiments, the plurality of ribs may provide the attachment method for joining the individual components to create the split fan collar orifice (e.g., the completed orifice) for use in an airflow system. In other words, the end of the member may be a vertical rib that provides structural support, and may also serve as a mating surface to mate with another surface. The split fan collar orifice described can allow for smaller molds, increased quantities in packages, less expensive individual piece price, increased rigidity of structure, or combinations thereof.

Referring to FIG. 1, an illustrative embodiment of a half-collar 100 is shown in a perspective view. The half-collar 100 can be made of a polymer, plastic, sheet metal, fiber glass, carbon fiber, billet metals, cast metals, or the like. In some embodiments, the half-collar 100 may be formed by injection molding, 3D printing capabilities, casting milling, or from a mold. The half-collar 100 can be a single piece, unitary construction.

The half-collar 100 includes a generally semi-annular member 101. The term "generally" is subject to manufacturing tolerances or the like. For example, the half-collar 100 can be a semi-circle. The member 101 can have an arc of approximately 180 degrees. In some examples, the member 101 may have an arc (e.g., circle arc) that is greater than a minor arc and less than a major arc. That is, the member 101 may be oval-shaped, for example, and may not necessarily be circular. The member 101 may have an inner surface 107 and an outer surface 109. The inner surface 107 is an interior portion of the member 101. The outer surface 109 is an exterior portion of the member 101. The inner surface 107 may be a smooth surface. In the illustrated embodiment, the outer surface 109 includes raised portions (e.g., ribs), as discussed further below.

The member 101 has a first end 104 and a second end 102. The first end 104 and the second end 102 are located at opposite ends of the member 101. For example, the first end 104 and the second end 102 can be at opposite ends of the semi-circle formed by the member 101. The member 101 has a first mating surface 108 (not shown in FIG. 1; shown in FIG. 4A) on the first end 104 and a second mating surface 106 on the second end 102. The first mating surface 108 (e.g., a flange at the end of the first end 104) and the second mating surface 106 (e.g., a flange at the end of the first end 102) can be formed between the inner surface 107 and the outer surface 109 at the respective end of the member 101. The first mating surface 108 and the second mating surface 106 are configured to be joined with another surface. The respective mating surfaces 108, 106 of the member 101 can form a secured-connection with surfaces of a different member (e.g., see FIG. 3B and corresponding description).

In some embodiments, the first mating surface 108 and the second mating surface 106 may be different. For example, the first mating surface 108 may have different dimensions or structures than the second mating surface 106. For example, the first mating surface 108 can include an alignment post (e.g., 222 in FIG. 2) and the second mating surface 106 can have an alignment post-hole 110, as discussed further with respect to FIG. 2.

The member 101 may include a plurality of apertures 112-1, 112-2 and a plurality of surface apertures 120-1, 120-2, 120-3, 120-4. The plurality of apertures are collectively referred to as 112-N and the plurality of surface apertures are collectively referred to as 120-N. In the illustrated embodiment, the plurality of apertures 112-N includes a first aperture 112-1 and a second aperture 112-2. It will be appreciated that the number of apertures 112-N is an example and is not intended to be limited to two apertures. In the illustrated embodiment, the plurality of surface apertures 120-N include a first surface aperture 120-1, a second surface aperture 120-2, a third surface aperture 120-3, and a fourth surface aperture 120-4. It will be appreciated that the number of surface apertures 120-N is an example and is not intended to be limited to four surface apertures.

The plurality of apertures 112-N and the plurality of surface apertures 120-N can be different sizes. That is, the plurality of apertures 112-N and the plurality of top surface apertures 120-N can have different diameters. For example, the plurality of surface apertures 120-N can be relatively larger than the first aperture 112-1 and the second aperture 112-2 (e.g., diameters of surface apertures 120-N are greater than diameters of apertures 112-N). In some embodiments, the plurality of apertures 112-N and the plurality of surface apertures 120-N can be the same size (e.g., having a same diameter, etc.).

The plurality of apertures 112-N and the plurality of surface apertures 120-N can be formed in different areas of the member 101 relative to each other. For example, the first aperture 112-1 and the second aperture 112-2 may be formed on the first mating surface 108, while the surface apertures 120-N (e.g., third apertures) may be formed on a top surface 111 or a bottom surface 113 of the member 101. The size and location of the apertures 112-N and the surface apertures 120-N can be configured relative to the components being received. The first aperture 112-1 and the second aperture 112-2 can be configured to receive a fastener or the like. The surface aperture 120-N (e.g., third aperture) can be configured to receive a fan guard-leg, as discussed further with respect to FIG. 2 and FIG. 4A.

In the illustrated embodiment, member 101 includes a plurality of ribs 116-1, 116-2, 118-1, 118-2 disposed along the outer surface 109 of the member 101. The plurality of ribs 116-1, 116-2 are collectively referred to as 116-N and the plurality of ribs 118-1, 118-2 are collectively referred to as 118-N. The plurality of ribs 116-N, 118-N can provide rigidity to the member 101. The plurality of ribs 116-N, 118-N can provide structural support to the member 101, which can prevent deformation (i.e., distorting, bending, or the like) of the member 101, for example, when stacked (e.g., nested) with one or more additional members 101 (e.g., storage, transport, longitudinal rigidity, or the like).

In some embodiments, the plurality of ribs 116-N, 118-N includes a number of first ribs 118-N and a number of second ribs 116-N. The number of first ribs 118-N extend in a first direction and the number of second ribs 116-N extend in a second direction. The second direction is different from the first direction. This orientation may form an angle θ at an intersection point. The angle θ formed at a meeting point between the number of ribs 118-N, 116-N may be approximately 90 degrees. It will be appreciated that the number of ribs 116-N, 118-N is an example and is not intended to be limited to the number illustrated in FIG. 1.

In some embodiments, the first direction may be a longitudinal direction relative to a longitudinal axis of the member 101 and the second direction may be a circumferential direction about a circumference of the member 101. The second direction (e.g., along the circumference of the member 101) may be different than the first direction (e.g., along the longitudinal direction of the member 101). For example, the plurality of ribs 116-N, 118-N may angle along the outer surface 109 of the member. The first ribs 118-N and the second ribs 116-N may be substantially perpendicular to each other. The term "substantially" is subject to manufacturing tolerances and the like. In such embodiments, the first ribs 118-N and the second ribs 116-N may form an angle θ larger than 90 degrees at the meeting point between the ribs 118-N, 116-N.

In some embodiments, the half-collar 100 can include a conduit knock-out 114 disposed on the member 101. The conduit knock-out 114 is a portion of the member 101 that may be removable from the member 101 (e.g., by knocking out, drilling out, or the like). The conduit knock-out 114 is configured to form a hole in the member 101 when knocked out. The hole formed by the conduit knock-out 114 can receive wiring and/or other components when the member 101 is part of a fan assembly (described in further detail with respect to FIGS. 4A and 4B). In some embodiments, the conduit knock-out 114 can be located nearer to the first end 104 or the second end 102 of the member 101 relative to a center C of the member 101 (e.g., along the circumference of the member 101).

In some embodiments, the member 101 and the conduit knock-out 114 can be made of different materials. For example, the member 101 can include a polymer and the conduit knock-out 114 can include a different polymer. In some embodiments, the member 101 and the conduit knock-out 114 can be made of the same material having different thicknesses. For example, the first material may be a polymer and the second material may be the same polymer, each having a different thickness. The second material may be a thinner material (e.g., decreased thickness) than the first material. In such embodiments, thinner material that makes up the conduit knock-out 114 is configured to be capable of breaking from the member 101 to form the hole. That is, the conduit knock-out breaks along the circumference to be removed from the member 101.

In some embodiments, a thickness t1 of each of the plurality of ribs 116-N, 118-N is less than a thickness t2 of the member 101. That is, the material comprising the plurality of ribs 116-N, 118-N may be a different thickness than the member 101. For example, the plurality of ribs 116-N, 118-N may be thinner than the thickness t2 of the member 101.

In some embodiments, a ratio of the thickness t1 of the plurality of ribs 116-N, 118-N to the thickness t2 of the member 101 is at or about 2:3. That is, t2 is greater than t1 (i.e., t2>t1). In some embodiments, the ratio of thicknesses t1, t2 is less than 2:3. In some embodiments, the 2:3 ratio thickness may prevent lines forming from an injection molding process and/or avoid sharp edges from forming, which may compromise structural integrity of the half-collar 100 and/or the assembled split fan collar orifice. It is to be appreciated that the ratios are examples and can vary beyond the stated values within the scope of this disclosure.

Figure 2:
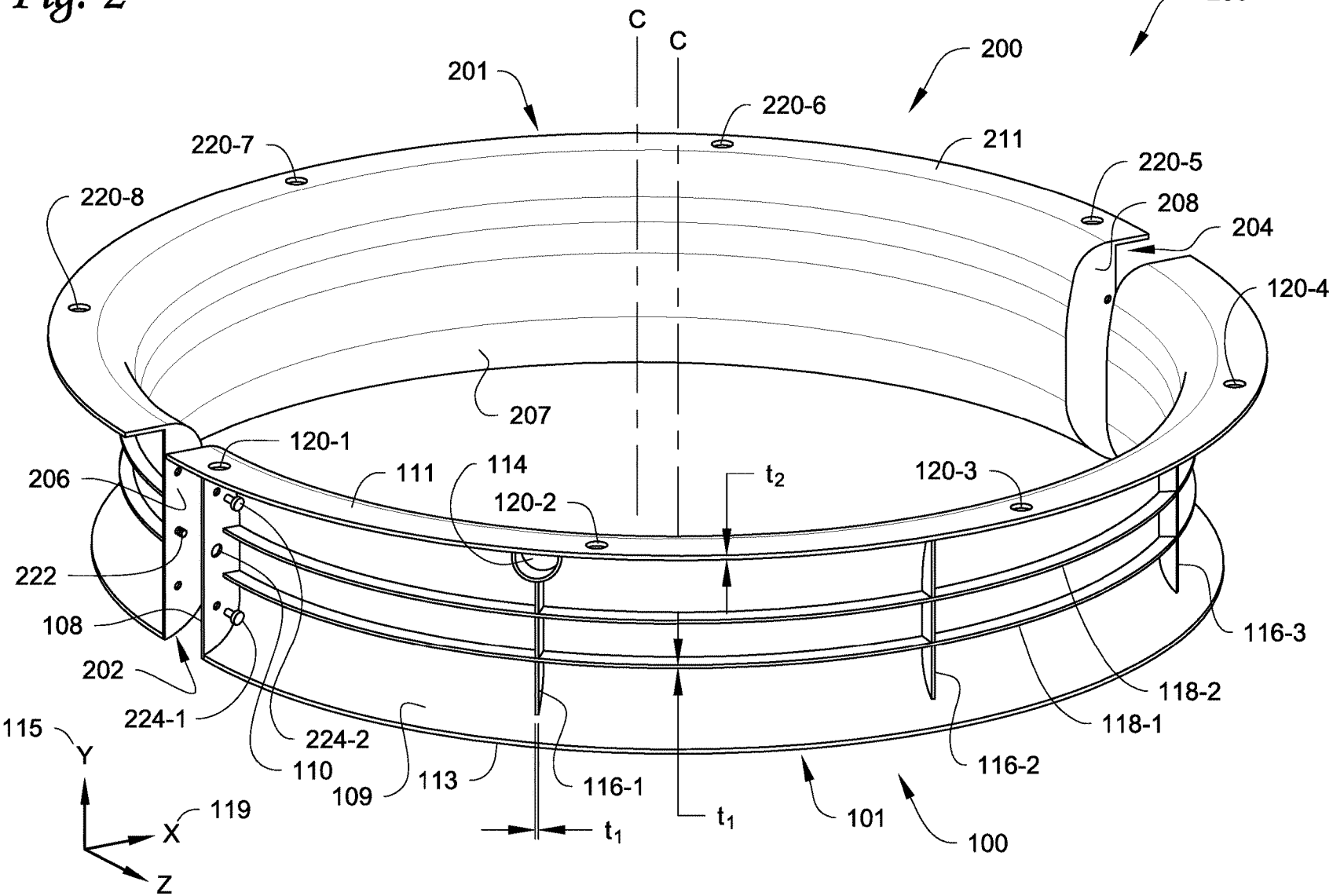
FIG. 2 illustrates an exploded perspective view of a split fan collar orifice, according to some embodiments.

FIG. 2 illustrates an exploded perspective view of a split fan collar orifice 250, according to some embodiments. The split fan collar orifice 250 includes two half-collars 100 (FIG. 1). One of the two half-collars may be the first half-collar 100 as described in FIG. 1. The second of the two half-collars may be a second half-collar 200 that is identical to the first half-collar 100.

For simplicity of this Specification, features of the first half-collar 100 described previously will not be described in additional detail. The second half-collar 200 includes the same or similar features as the first half-collar 100. Same or similar feature(s) in FIG. 2 are designated with the same digits in the one and ten place value as the corresponding feature(s) in FIG. 1. For example, third apertures 120-N in first member 101 is an identical feature to the aperture 220-N in second member 201.

In some embodiments, the first half-collar 100 and the second half-collar 200 are identical. The half-collars may be rotated about one or more axes. For example, the half-collars are rotated about an axis 115 such that the two half-collars 100, 200 are mirrored relative to each other. In the illustrated embodiment, the second half-collar 200 may be rotated about an axis 119 such that the half-collars 100, 200 are oppositely aligned, as illustrated in FIG. 2. That is, the second half-collar 200 is mirrored and flipped across the axis 119 to oppose the first half-collar 100. When assembled, the first half-collar 100 and the second half-collar 200 form a complete orifice (e.g., the split fan collar orifice 250).

The second half-collar 200 includes the second member 201. The second member 201 also includes an arc and is generally semi-annular. The second member 201 includes a third end 202 and a fourth end 204. The third end 202 and the fourth end 204 are located at opposite ends of the member 201. That is, the third end 202 and the fourth end 204 are located at opposite ends of the arc (e.g., half circle). The second member 201 includes a third mating surface 206 on the third end 202, and a fourth mating surface 208 on the fourth end 204.

The second mating surface 106 and the third mating surface 206 can include an alignment post 222. The alignment post 222 can be a protrusion from the surface of the respective mating end. In some embodiments, the protrusion 222 can be made of the same material or different material as the respective member 101, 201. In some embodiments, the alignment post 222 can vary in size and/or shape. For example, the alignment post 222 may be a cross-shape, round, or the like.

The first mating surface 108 and the fourth mating surface 208 can include an alignment post-hole 110. The alignment post-hole 110 is an opening on the surface of the respective mating end. In some embodiments, a size (e.g., diameter) of the alignment post-hole 110 may correlate with the size of the alignment post 222. For example, the alignment post-hole 110 may be about the same diameter or slightly larger than the diameter of the alignment post 222.

The mating surfaces 106, 108, 206, 208 of the members 101, 201 may include a plurality of apertures 112-N, 212-N and connectors 224-N. That is, the respective mating ends can include openings on the surface that are configured to receive a respective connector 224-N. The connectors 224-N may include at least one rivet, screw, bolt, or the like. The apertures 112-N, 212-N can vary in size and/or shape based on the size/shape of the connector 224-N.

The mating surfaces 106, 108, 206, 208 of the members 101, 201 may be connected to form the split fan collar orifice 250 (e.g., the complete orifice), as discussed below.

Figure 3A:
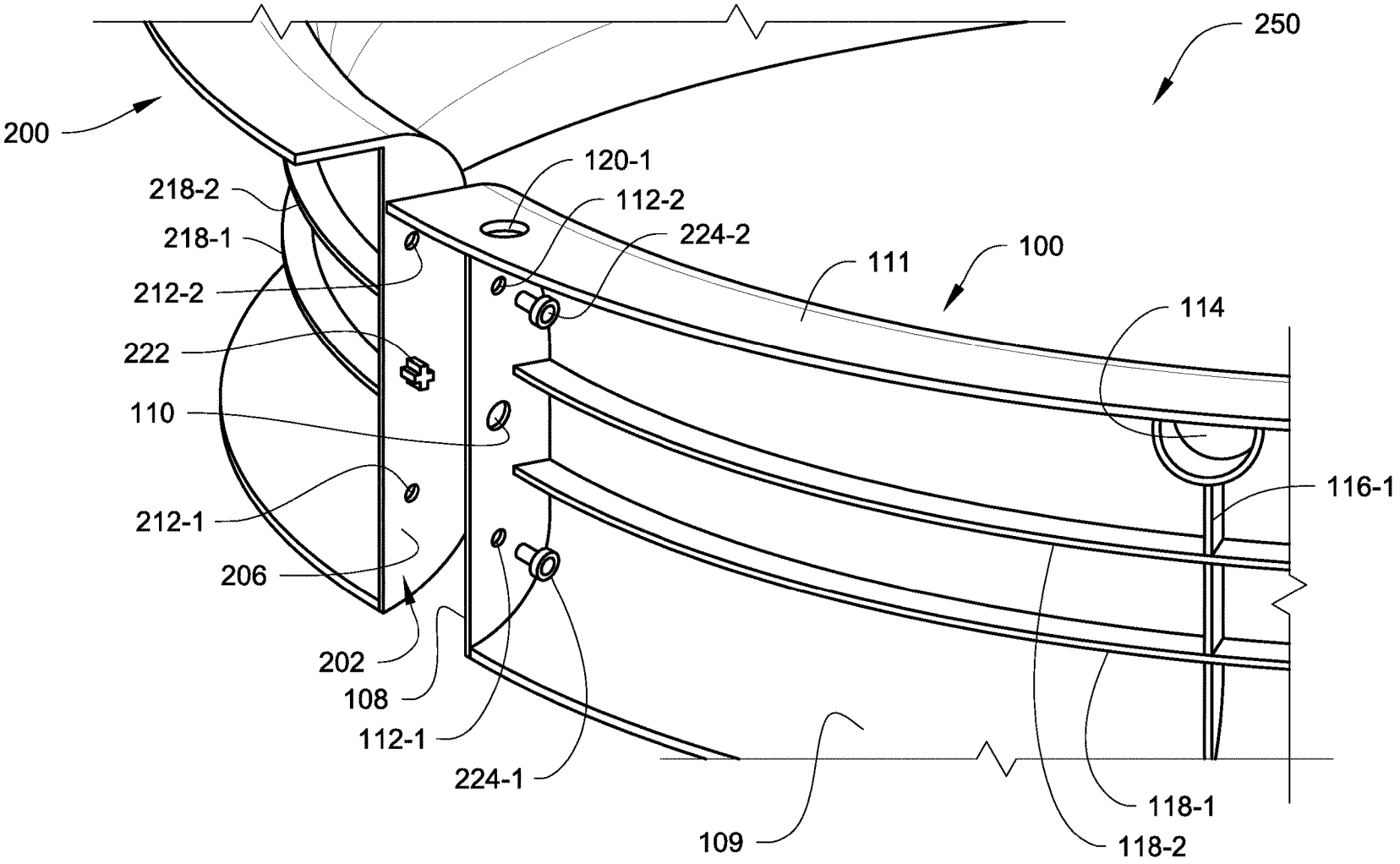
FIG. 3A illustrates a partial exploded view of a split fan collar orifice assembly, according to some embodiments.
Figure 3B:
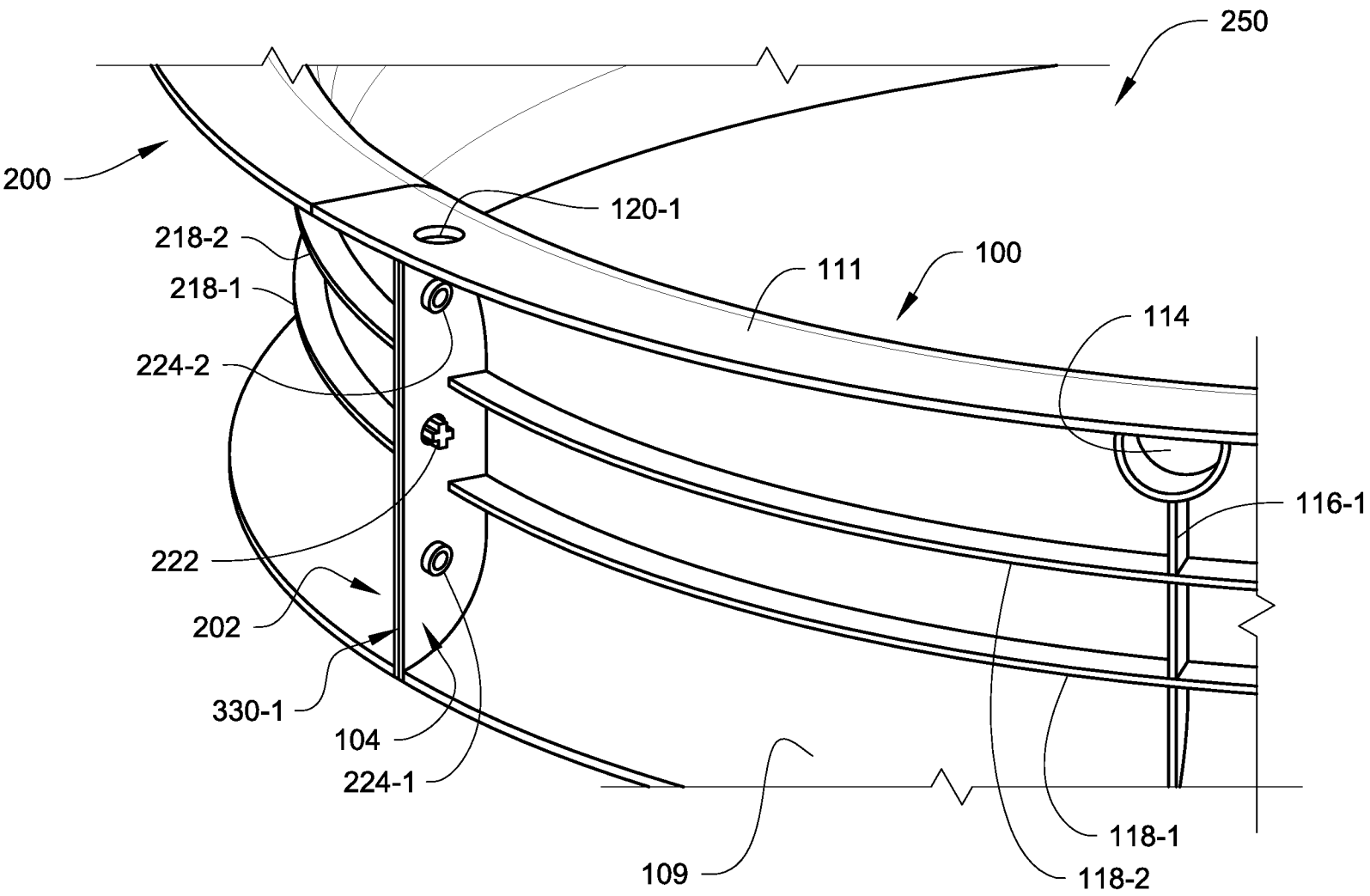
FIG. 3B illustrates a partial perspective view of the split fan collar orifice assembly in connection to FIG. 3A, according to some embodiments.
Figure 3C:
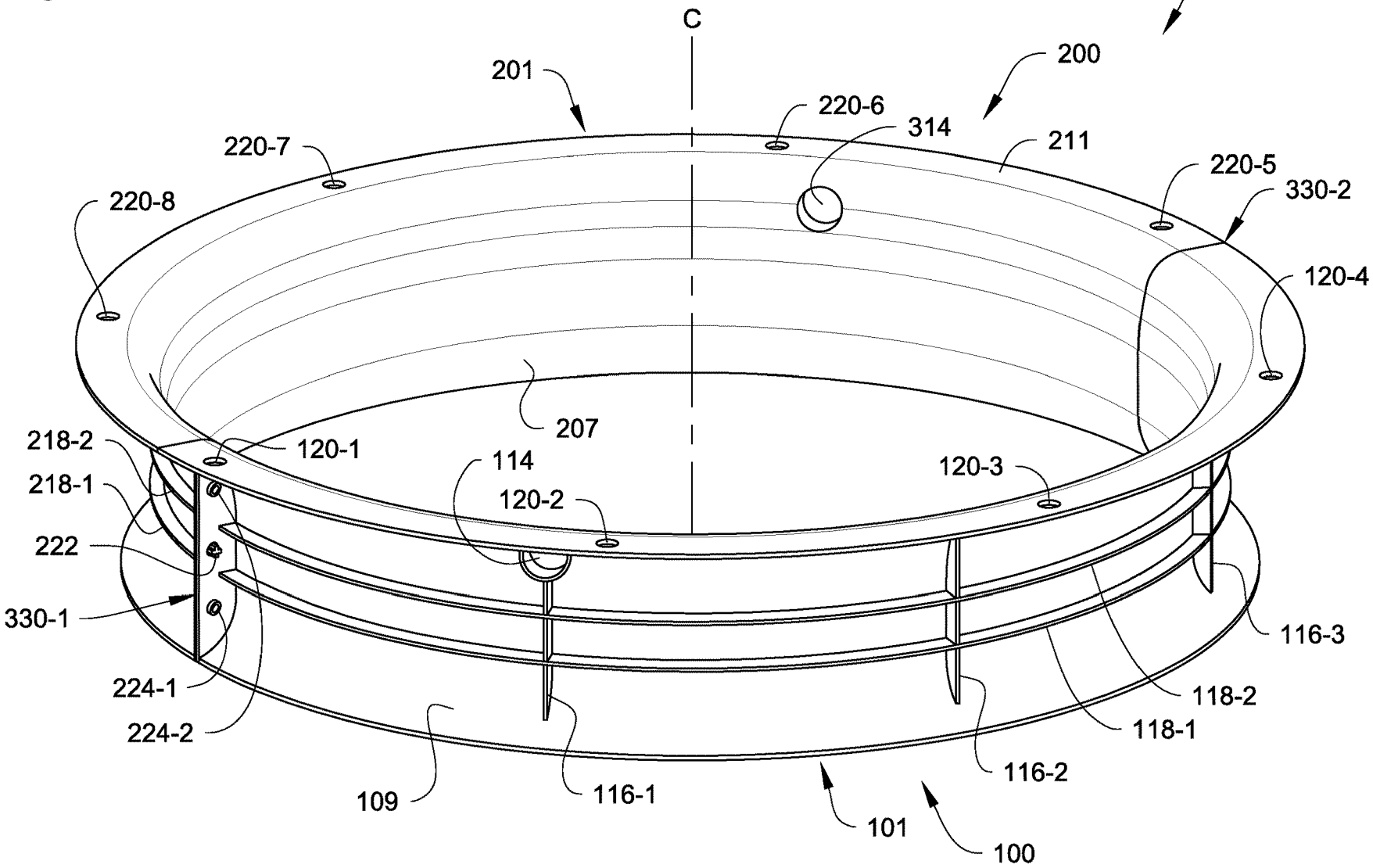
FIG. 3C illustrates a perspective view of the assembled split fan collar orifice of FIG. 2 when assembled, according to some embodiments.

FIG. 3A illustrates a partial exploded view of a split fan collar orifice 250 assembly, according to some embodiments. FIG. 3B illustrates a partial perspective view of the split fan collar orifice 250 assembly connection of FIG. 3A, according to some embodiments. FIG. 3C illustrates a perspective view of the assembled split fan collar orifice 250, according to some embodiments.

As illustrated in FIG. 3A, 3B, 3C, the first half-collar 100 and the second half-collar 200 can be joined to form the split fan collar orifice 250. The first member 101 and the second member 201 are joined together to form a secured-connection 330-N, as shown in FIGS. 3B and 3C.

To assemble the orifice 250, the first mating surface 108 and the third mating surface 206 are abutted such that the respective surfaces are in contact. A first secured-connection 330-1 is formed between the first mating surface 108 and the third mating surface 206. The second mating surface 106 and the fourth mating surface 204 are abutted such that the respective surfaces are in contact. A second secured-connection 330-2 is formed between the second mating surface 106 and the fourth mating surface 204. When connected, the first member 101 and the second member 201 having the respective arcs/semi-annular shapes form the orifice (e.g., the split fan collar orifice 250).

When the respective mating ends of the member 101, 201 are joined, the alignment post-hole 110 is configured to receive the alignment post 222 to form an intermediate connection between the surfaces of the respective members 101, 201. The intermediate connection is formed when the first member 101 with the first mating surface 108 having the alignment post-hole 110 receives the alignment post 222 on the third mating surface 206 of the second member 201. Additionally, the intermediate connection is formed when the second member 201 having the fourth mating surface 208 that includes an alignment post-hole (not shown) receives the alignment post (not shown) disposed on the second mating surface 106 of the first member 101.

The plurality of apertures 112-N, 212-N on the mating surfaces 108, 106, 206, 208 are configured to receive a respective connector 224-N to form a secure-connection 330-N between the respective surfaces of the respective members 101, 201. As described above with respect to FIG. 2, the first member 101 and the second member 201 include a plurality of apertures 112-N, 212-N. The plurality of apertures 112-N are formed on the first mating surface 108 and second mating surface 106, while the plurality of apertures 212-N are formed on the third mating surface 206 and fourth mating surface 204. In some embodiments, the plurality of apertures 112-N, 212-N can be the same size (e.g., diameter) or different sizes. For example, apertures 112-1, 212-1 may be the same size as apertures 112-2, 212-2. In some embodiments, a size of plurality of apertures 112-N, 212-N is smaller than a size of the alignment post-hole 110.

In some embodiments, the plurality of surface apertures 120-N (e.g., third aperture) formed on a top surface 111 of the first member 101 and the second member 201 can be larger than the first aperture 112-N, 212-N and/or the alignment post-hole 110 (e.g., second aperture). That is, the diameter of the opening of surface aperture 120-N is larger than the diameter of the opening of aperture 112-N, 212-N and/or the diameter of the alignment post-hole 110).

The split fan collar orifice 250 can include a conduit knock-out 114, 314 on at least one of the first member 101 or the second member 201. For example, as illustrated in FIG. 3C, the conduit knock-out 314 forms an opening on the second member 201, while the conduit knock-out 114 is sealed on the first member 101. It will be appreciated that in some embodiments, each member 101, 201 can include a conduit knock-out 114, 314 with material that can be removed to form a hole. That is, the split fan collar orifice 250 may include two openings as a result of respective conduit knock-outs 114, 314. The two openings may be useful when installing the fan.

Figure 4A:
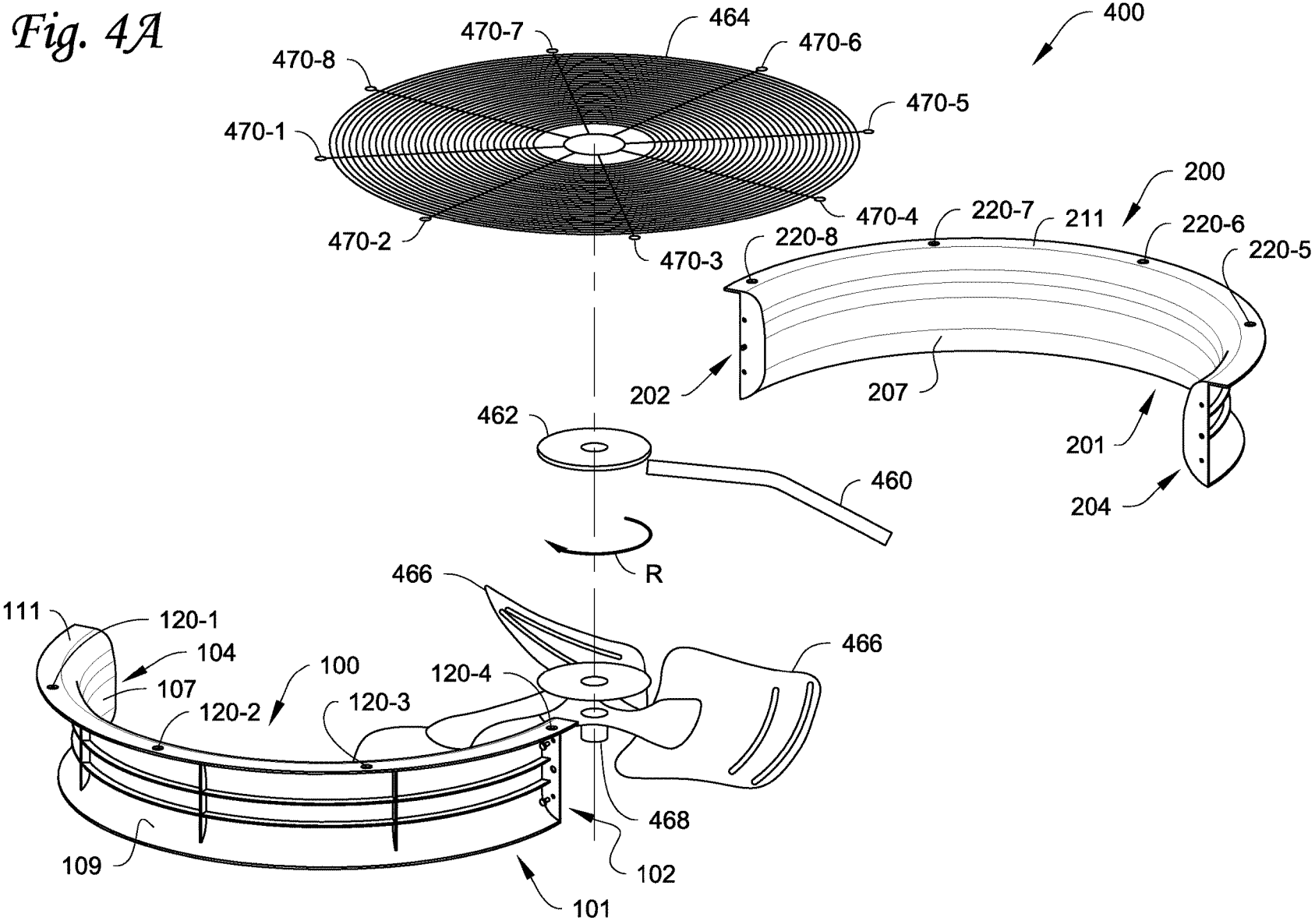
FIG. 4A illustrates an exploded view of a fan assembly having a split fan collar orifice, according to some embodiments.
Figure 4B:
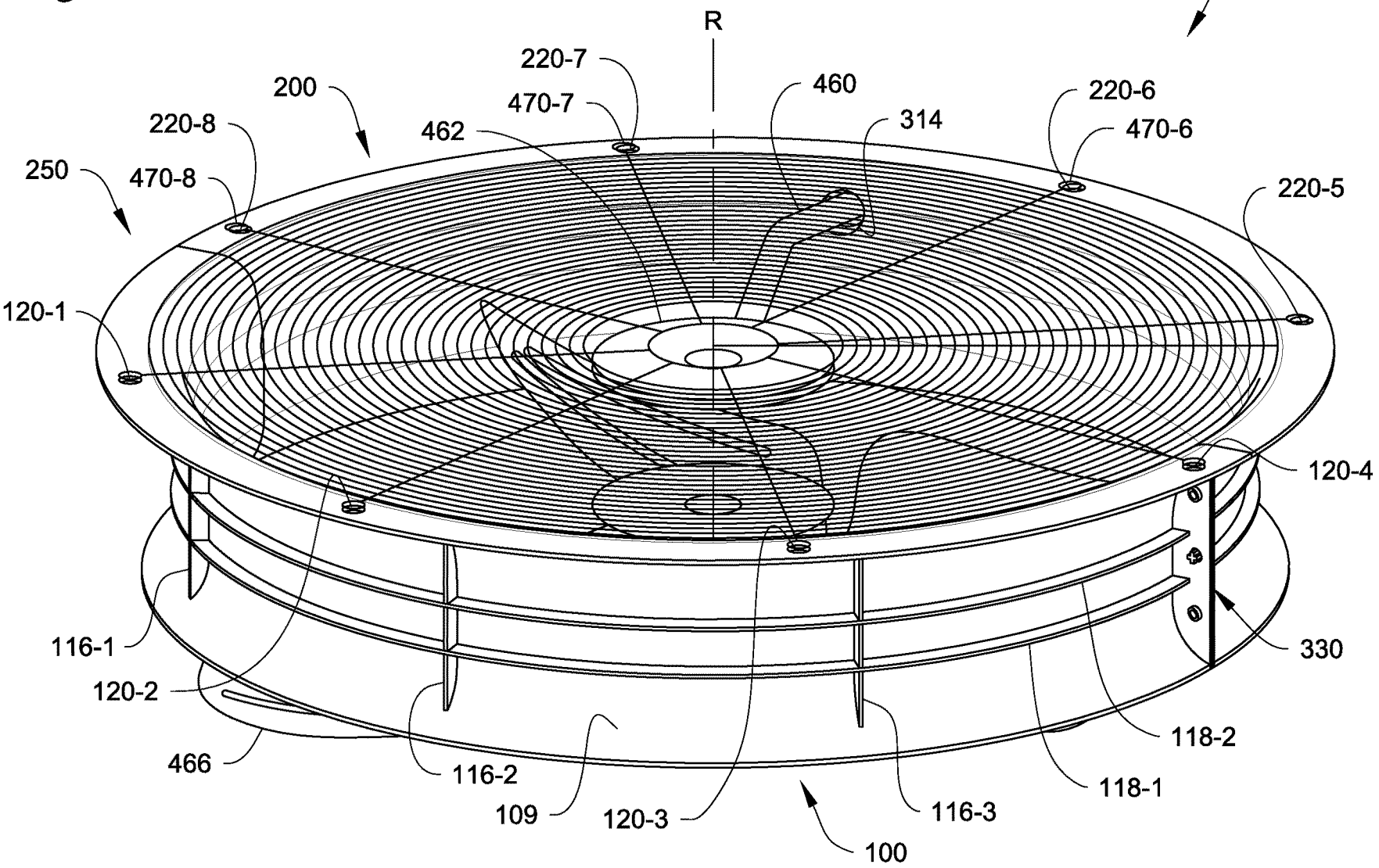
FIG. 4B illustrates an assembled view of the fan assembly having the split fan collar orifice in FIG. 4A, according to some embodiments.

FIG. 4A illustrates an exploded view of a fan assembly 400 having a split fan collar orifice 250, according to some embodiments. FIG. 4B illustrates an assembled view of the fan assembly 400 having the split fan collar orifice 250 in FIG. 4A, according to some embodiments. The fan assembly 400 includes the split fan collar orifice 250, a motor 462, a conduit 460, a plurality of blades 466, and a guard 464. It is to be appreciated that the fan assembly 400 can include additional or fewer components, according to some embodiments.

The split fan collar orifice 250 includes the first half-collar 100 and second half-collar 200, as described above. The split fan collar orifice 250 surrounds the motor 462 connected to the plurality of blades 466 installed on a central hub 468. The motor 462 can be drive plurality of blades 466. A shaft (not shown) connects the motor 462 and the blades 466, which can be located along a line R, such that the shaft and the motor 462 have the same axis of rotation. The motor 462 and plurality of blades 466 can have an axis of rotation as illustrated by the line R. The motor 462 and the plurality of blades 466 may rotate about the axis R in a single direction, such as a clockwise rotation, as indicated by the arrows.

It is to be appreciated that the configuration of the impeller may vary according to an application of the fan assembly 400. For example, in some embodiments, the impeller can be driven by, for example, an electric motor or the like. The design of the impeller can vary and may, for example, be determined by the application in which the fan is to be used. For example, the impeller can have different designs depending on the type of refrigeration unit (or an application for a fan assembly other than a refrigeration unit) in which the fan assembly 400 is used. For example, the design may vary based on a designed of a particular refrigeration unit (e.g., size, capacity, or the like).

The conduit 460 may be connected to the motor 462. The conduit 460 can include wiring, which may connect to a power source to provide power to the motor 462. The conduit 460 may extend from the orifice through a conduit knock-out 314 formed in a surface of the split fan collar orifice 250. For example, the conduit 460 may extend from the motor 462 to the conduit knock-out 314 formed in the second half-collar 200 of the split fan collar orifice 250. In some embodiments, the first half-collar 100 may not have a corresponding conduit knock-out (e.g., 114 in FIG. 1). The conduit 460 can provide a connection between the motor 462 and a component external to the split fan collar orifice 250. The conduit 460 may include wirings, or a casing for wirings, that provide power to the motor 462 and/or the impeller.

The guard 464 can rest on a top surface 111 of the split fan collar orifice 250. The guard 464 may include a plurality of projections 470-1, 470-2, 470-3, 470-4, 470-5, 470-6, 470-7, 470-8. The plurality of projections are collectively referred to as 470-N. The plurality of projections 470-N may rest and/or be secured within the plurality of surface apertures 120-N on the top surface 111 of the split fan collar orifice 250. For example, a respective projection 470-1, 470-2 . . . 470-N of the guard 464 may rest and/or be secured within a respective surface aperture 120-1, 120-2 . . . 120-N of the split fan collar orifice 250. The guard 464 can be a structure that prevents debris, parts, and/or other foreign substances from coming into contact with the motor 462 and blades 466.

Aspects:

Any one of aspects 1-7 can be combined with any one of aspects 8-14 and 15-18. Any one of aspects 8-14 can be combined with any one of aspects 15-18.

Aspect 1. A half-collar apparatus, comprising: a generally semi-annular member having a first end and a second end, the member having an inner surface and an outer surface; a first mating surface on the first end and a second mating surface on the second end, wherein the first mating surface and the second mating surface are different; and a plurality of ribs disposed along the outer surface of the member, the plurality of ribs configured to provide rigidity to the member, the plurality of ribs including a first rib and a second rib, the first rib extends in a first direction and the second rib extends in a second direction.

Aspect 2. The half-collar apparatus of aspect 1, wherein the second direction is different from the first direction, the first rib and the second rib are substantially perpendicular.

Aspect 3. The half-collar apparatus of aspect 2, wherein the first direction is a longitudinal direction relative to the member and the second direction is a circumferential direction about a circumference of the member, the second direction being longer than the first direction, and wherein the plurality of ribs are angled along the outer surface of the member.

Aspect 4. The half-collar apparatus of aspect 3, further comprising: a conduit knock-out on the member to configured to form a hole in the member, the conduit knock-out located nearer to the first end or the second end of the member than a center of the member.

Aspect 5. The half-collar apparatus of any one of aspects 1-4, wherein the member is made of a first material and the conduit knock-out is made of a second material, the second material being a thinner material than the first material, the thinner material capable of removal from the member to form the hole, wherein the first material and the second material are the same material having different thicknesses.

Aspect 6. The half-collar apparatus of any one of aspects 1-5, wherein the second mating surface includes an alignment post, and the first mating surface has an alignment post-hole.

Aspect 7. The half-collar apparatus of any one of aspects 1-6, wherein a thickness of each of the plurality of ribs is less than a thickness of the member, and a ratio of the thickness of the plurality of ribs to the thickness of the member is 2:3 or less.

Aspect 8. A fan orifice assembly, comprising: a semi-annular first member, the first member having a first mating end and a second mating end; a semi-annular second member, the second member having a third mating end and a fourth mating end; a first secured-connection between the first mating end and the third mating end; a second secured-connection between the second mating end and the fourth mating end; in a secured state, the first member and the second member form an orifice; and a plurality of ribs disposed along an outer surface of the first member and the second member.

Aspect 9. The fan orifice assembly of aspect 8, further comprising a conduit knock-out on at least one of the first member and the second member, wherein the conduit knock-out is disposed closer to a respective mating end than a center of the respective member.

Aspect 10. The fan orifice assembly of any one of aspects 8 or 9, wherein the secured-connection further includes: an alignment post formed on the second mating end and the third mating end, and an alignment post-hole disposed on the first mating end and a fourth mating end of the second section.

Aspect 11. The fan orifice assembly of any one of aspects 8-10, wherein an inner surface of the first member and second member is smooth.

Aspect 12. The fan orifice assembly of any one of aspects 8-11, further comprising a plurality of apertures and connectors, the connectors being at least one of a rivet, screw, or bolt.

Aspect 13. The fan orifice assembly of any one of aspects 8-12, further comprising a plurality of apertures, the plurality of apertures including a first aperture, a second aperture, and a third aperture, the first aperture and the second aperture formed on the first mating end and the fourth mating end, wherein the first aperture is smaller than the second aperture, the third aperture formed on a top surface of the first member and the second member, wherein the third aperture is larger than the first aperture and the second aperture.

Aspect 14. The fan orifice assembly of any one of aspects 8-13, wherein the first aperture is configured to receive a connector to form the secured-connection between the first mating end and the third mating end, and the secured-connection between the second mating end and the fourth mating end, the second aperture is configured to receive the alignment post to form the secured-connection, and the third aperture is configured to receive a guide-leg of a fan guard of the assembly.

Aspect 15. A method of manufacturing a fan orifice, comprising: forming a first member according to aspect 8; forming a second member according to aspect 8, the second member being identical to the first member; securing the first member to the second member to form the fan orifice.

Aspect 16. The method of manufacturing of aspect 15, further comprising rotating the second member about a first axis to a first position and further rotating the second member about a second axis to a second position, wherein the second member in the second position mirrors the first member.

Aspect 17. The method of manufacturing of aspects 15 or 16, wherein the method of manufacturing is a unitary construction for each of the members.

Aspect 18. The method of manufacturing of any one of aspects 15-17, wherein the forming the first member and the forming the second member are performed via injection molding.

While the concepts of the present disclosure are susceptible to various modifications and alternative forms, specific embodiments thereof have been shown by way of example in the drawings and described herein in detail. It should be understood, however, that there is no intent to limit the concepts of the present disclosure to the particular forms disclosed, but on the contrary, the intention is to cover all modifications, equivalents, and alternatives consistent with the present disclosure and claims.

While certain illustrative embodiments have been described in detail in the drawings and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus and methods described herein. It will be noted that alternative embodiments of the apparatus and methods of the present disclosure may not include all of the features described yet still benefit from at least some of the advantages of such features. Those of ordinary skill in the art may readily devise their own implementations of the apparatus and methods that incorporate one or more of the features of the present disclosure.

What is claimed is:

1. A half-collar apparatus, comprising:

a generally semi-annular member having a first end and a second end, the member having an inner surface and an outer surface;

a first mating surface on the first end and a second mating surface on the second end, wherein the first mating surface and the second mating surface are different; and a plurality of ribs disposed along the outer surface of the member, the plurality of ribs configured to provide rigidity to the member, the plurality of ribs including a first rib and a second rib, the first rib extends in a first direction and the second rib extends in a second direction.

2. The half-collar apparatus of claim 1, wherein the second direction is different from the first direction, and the first rib and the second rib are substantially perpendicular.

3. The half-collar apparatus of claim 1, wherein the first direction is a longitudinal direction relative to the member, the second direction is a circumferential direction about a circumference of the member, the extension in the second direction is longer than the extension in the first direction, and the plurality of ribs are angled along the outer surface of the member.

4. The half-collar apparatus of claim 1, further comprising:

a conduit knock-out on the member configured to form a hole in the member, the conduit knock-out located nearer to the first end or the second end of the member than a center of the member.

5. The half-collar apparatus of claim 4, wherein the member is made of a first material and the conduit knock-out is made of a second material, the second material being a thinner material than the first material, the thinner material capable of removal from the member to form the hole, wherein the first material and the second material are the same material having different thicknesses.

6. The half-collar apparatus of claim 1, wherein the second mating surface includes an alignment post, and the first mating surface has an alignment post-hole.

7. The half-collar apparatus of claim 1, wherein a thickness of each of the plurality of ribs is less than a thickness of the member, and a ratio of the thickness of each of the plurality of ribs to the thickness of the member is 2:3 or less.

8. A fan orifice assembly, comprising:

a semi-annular first member, the first member having a first mating end and a second mating end, the first mating end having a first mating surface, the second mating end having a second mating surface, the first mating surface and the second mating surface are different;

a semi-annular second member, the second member having a third mating end and a fourth mating end, the third mating end having a third mating surface, the fourth mating end having a fourth mating surface, the third mating surface and the fourth mating surface are different;

a first secured-connection between the first mating end and the third mating end;

a second secured-connection between the second mating end and the fourth mating end;

in a secured state, the first member and the second member form an orifice; and a plurality of ribs disposed along an outer surface of the first member and the second member, the plurality of ribs configured to provide rigidity to the first and the second member, the plurality of ribs including a first rib and a second rib, the first rib extends in a first direction and the second rib extends in a second direction.

9. The fan orifice assembly of claim 8, further comprising a conduit knock-out on at least one of the first member and the second member, wherein the conduit knock-out is disposed closer to the first or second mating end than a center of the first member when the conduit knock-out is on the first member, or disposed closer to the third or fourth mating end than a center of the second member when the conduit knock-out is on the second member.

10. The fan orifice assembly of claim 8, wherein the fan orifice assembly further comprises:

an alignment post formed on the second mating end and the third mating end, and an alignment post-hole disposed on the first mating end and the fourth mating end.

11. The fan orifice assembly of claim 8, wherein an inner surface of the first member and the second member is smooth.

12. The fan orifice assembly of claim 8, further comprising a plurality of apertures and connectors, the connectors being at least one selected from the group consisting of a rivet, screw, and bolt.

13. The fan orifice assembly of claim 8, further comprising a plurality of apertures, the plurality of apertures including a first aperture, a second aperture, and a third aperture, the first aperture and the second aperture formed on each of the first mating end and the fourth mating end, wherein the first aperture is smaller than the second aperture, the third aperture formed on a top surface of each of the first member and the second member, wherein the third aperture is larger than the first aperture and the second aperture.

14. The fan orifice assembly of claim 13, wherein the first aperture is configured to receive a connector to form the first secured-connection between the first mating end and the third mating end, and the second secured-connection between the second mating end and the fourth mating end, the second aperture is configured to receive an alignment post to form an intermediate connection, and the third aperture is configured to receive a guide-leg of a fan guard of the fan orifice assembly.

15. A method of manufacturing the fan orifice assembly of claim 8, comprising:

forming the first member according to claim 8;

forming the second member according to claim 8, the second member being identical to the first member; and securing the first member to the second member to form the fan orifice assembly.

16. The method of manufacturing of claim 15, further comprising rotating the second member about a first axis to a first position and further rotating the second member about a second axis to a second position, wherein the second member in the second position mirrors the first member.

17. The method of manufacturing of claim 15, wherein the method of manufacturing is a unitary construction for each of the first and second members.

18. The method of manufacturing of claim 15, wherein said forming of the first member and said forming of the second member are performed via injection molding.

* * * * *